US006148444A

United States Patent [19]

Holmes et al.

[11] Patent Number: 6,148,444

[45] Date of Patent: Nov. 21, 2000

[54] HEMODIALYSIS GARMENT

[76] Inventors: Harry F. Holmes; Barbara S. Holmes, both of 17 Washington Ave., Chesilhurst, N.J. 08089

[21] Appl. No.: 09/458,384

[22] Filed: Dec. 10, 1999

[51] Int. Cl.[7] ..... A41B 1/00

[52] U.S. Cl. ..... 2/69; 2/90; 2/114

[58] Field of Search ..... 2/69, 90, 115, 2/94, 114, 106, 105, 73, 75, 77, 80, 109, 122, 121, 125, 126, 128, 113, 912, 913, 914, 915, DIG. 1, 2.15, 2.17

[56] References Cited

U.S. PATENT DOCUMENTS

| | | | |
|---|---|---|---|
| 1,489,046 | 4/1924 | Thompson | 2/114 |
| 2,981,954 | 5/1961 | Garbellano | 2/2.15 |
| 4,547,907 | 10/1985 | Netsky | 2/114 |
| 4,783,858 | 11/1988 | Chevalier | 2/90 |
| 4,977,622 | 12/1990 | Schley . | |
| 5,097,535 | 3/1992 | Dye et al. | 2/69 |
| 5,097,536 | 3/1992 | Cohen . | |
| 5,469,581 | 11/1995 | Uthoff | 2/69 |
| 5,553,323 | 9/1996 | Chou et al. | 2/114 |
| 5,564,126 | 10/1996 | Chou . | |
| 5,611,087 | 3/1997 | Adkins | 2/114 |
| 5,787,503 | 8/1998 | Murphy, III | 2/90 |
| 5,799,330 | 9/1998 | O'Donoghue-Kitt . | |

*Primary Examiner*—Gloria M. Hale
*Attorney, Agent, or Firm*—Henderson & Sturm LLP

[57] ABSTRACT

A garment 10 for use by patient's undergoing hemodialysis treatment. The garment includes a sweater member 20 having a pair of long sleeves 21, 22 provided with elongated sleeve openings 21', 22' which are controlled by pairs of cooperating hook and loop closure members 40/41 and a neck opening 23 which is provided with a vertical throat opening 23' also provided with a pair of closure members 40/41 and further including a layer of thermal material 30 which covers the upper chest and back of the patient's torso, as well s the upper arms.

14 Claims, 1 Drawing Sheet

HEMODIALYSIS GARMENT

BACKGROUND OF THE INVENTION

1. Field of the Invention

The present invention relates to the field of medical garments in general, and in particular to a garment that is specifically designed for patient's undergoing hemodialysis treatments.

2. Description of Related Art

As can be seen by reference to the following U.S. Pat. Nos. 4,977,622; 5,097,536; 5,799,330; 5,611,087; and 5,564,126, the prior art is replete with myriad and diverse medical garments that are designed to fulfill a variety of purposes.

While all of the aforementioned prior art constructions are more than adequate for the basic purpose and function for which they have been specifically designed, they are uniformly deficient with respect to their failure to provide a simple, efficient, and practical medical garment that is custom designed to address the particular concerns of patient's receiving hemodialysis treatments.

As many patients who undergo hemodialysis are aware, the facilities that house the hemodialysis machines are often cold and the procedure itself encourages the patients to wear relatively thin shirts and blouses so that the sleeves an easily be rolled up over the grafts or fistulas that connect the patient to the machine in a well recognized manner.

As a consequence of the foregoing situation, there has existed a longstanding need among hemodialysis machine users for a new and improved garment that is very warm and contains a series of openings that will allow access to grafts or fistulas, as well as catheters during medical procedures, and the provision of such a construction is a stated objective of the present invention.

BRIEF SUMMARY OF THE INVENTION

Briefly stated, the hemodialysis garment that forms the basis of the present invention comprises a main garment unit, a thermal unit, and a plurality of closure units. The garment unit includes a long sleeved sweater member having elongated sleeve openings controlled by the plurality of closure units and the thermal unit includes a layer of thermal material for covering the upper torso of the patient.

As will be explained in greater detail further on in the specification, due to the fact that many patients experience a chilling effect in the upper thoracic area of their bodies during hemodialysis, it is imperative that the thermal unit provide warmth to that area.

To that end, the layer of thermal material is dimensioned to cover the upper chest, upper back, and upper arms of the patient and the layer of thermal material extends upwardly from approximately the horizontal midline of the sweater member.

In addition, the elongated sleeve openings are provided to allow direct connection of the hemodialysis tubes to the patient's grafts or fistulas without the necessity of rolling up the garment sleeves. The closure units can be re-engaged to effectively seal the sleeve openings even when the hemodialysis tubes are positioned within one of the sleeve openings.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
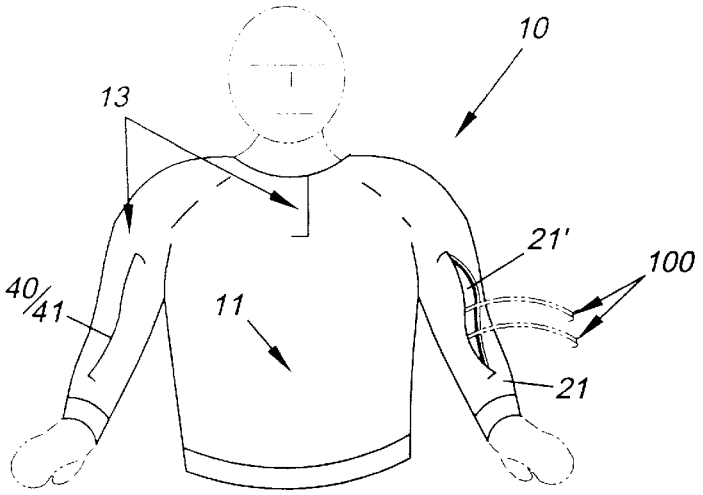
FIG. 1 is a perspective view of the hemodialysis garment in use.

As can be seen by reference to the drawings, and in particular to FIG. 1, the hemodialysis garment that forms the basis of the present invention is designated generally by the reference number 10. The garment 10 comprises in general, a main garment unit 11, a thermal unit 12, and a plurality of closure units 13. These units will now be described in seriatim fashion.

Figure 2:
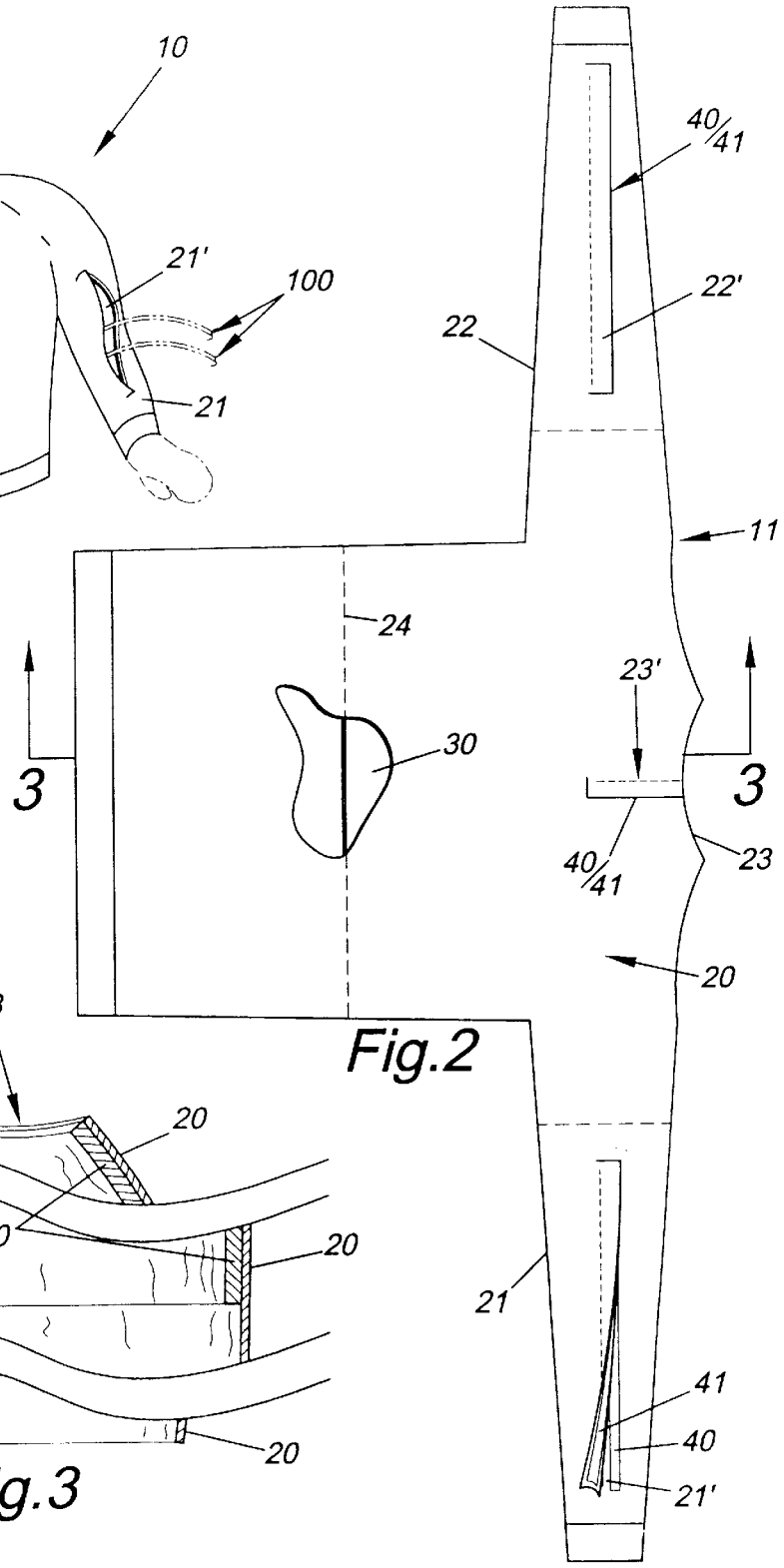
FIG. 2 is a top plan view of the hemodialysis garment.

As shown in FIGS. 1 and 2, the main garment unit 11 comprises a sweater member 20 having long sleeves 21, 22 and a crew neck style neck opening 23.

Figure 3:
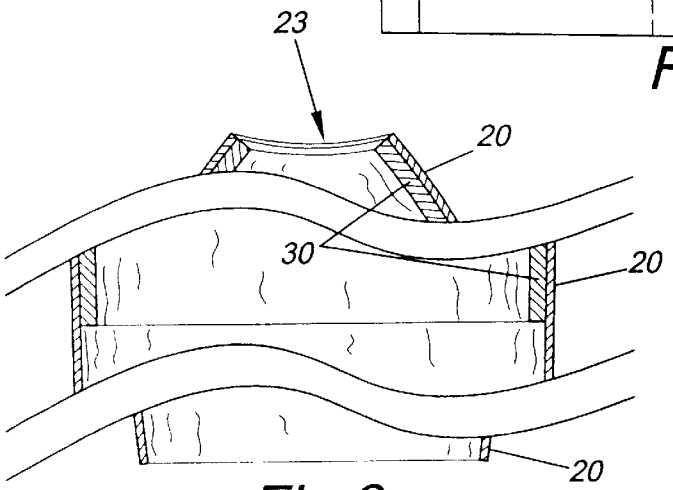
FIG. 3 is a cross sectional view taken through line 3—3 of FIG. 2.

Turning now to FIGS. 2 and 3, it can be seen that the thermal unit 12 comprises a layer of thermal material 30 such as fleece or the like, that is secured to the upper torso portion of the sweater member 20 such that the upper chest upper back and upper arms of the user are provided with a double layer of material. The outer layer comprises the sweater member 20 and the inner layer comprises the layer of thermal material 30.

As can best be seen by reference to FIG. 2, the layer of thermal material 30 extends upwardly from approximately the horizontal midline 24 of the sweater member 20 and extends outwardly to approximately the extent of a short sleeved undershirt (not shown) which may be worn under the dialysis garment 10 in accordance with the teachings of this invention.

Returning once more to FIGS. 1 and 2, it can be seen that the plurality of closure units 13 comprise a plurality of cooperating closure members in the form of hook and loop fasteners 40/41 that are disposed adjacent elongated openings 21', 22' formed on the sleeves 21, 22 of the sweater member 20, as well as a relatively short vertical throat opening 23' which extends downwardly from the sweater member neck opening 23 on the front portion of the sweater member.

By virtue of the foregoing arrangement, when a patient enters into a dialysis facility to receive treatment wearing the garment 10 of this invention, it is not necessary for the patient or technician to roll up the patient's sleeve to gain access to the grafts or fistulas that are connected to the dialysis machine, which under certain circumstances can cause irritation and or infection at the site of the grafts or fistulas.

Instead, one or more of the closure units 13 are opened to allow connection with the medical tubing 100. Then once the tubing 100 is in place, the cooperating fasteners 40/41 are reengaged on the opposite sides of the respective tubes 100 to prevent cold air from passing through the openings 21', 22', and 23'.

In addition, the layer of thermal material 30 serves to keep the upper torso of the patient warm during the dialysis process to offset the chill that many patient's experience during the time that they are hooked up to the dialysis machine.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A garment for patients to wear while undergoing hemodialysis procedures wherein the garment comprises:

a garment unit including a sweater member having a pair of long sleeves and a neck opening wherein at least one of the long sleeves is provided with an elongated sleeve opening;

a thermal unit including a layer of thermal material attached to the interior surface of the sweater member and dimensioned to cover at least the upper chest portion of the patient's torso; and a first pair of cooperating closure members for closing the elongated sleeve opening.

2. The garment as in claim 1 wherein said layer of thermal material is also dimensioned to cover the upper back portion of the patient's torso.

3. The garment as in claim 2 wherein said layer of thermal material is further dimensioned to cover the upper arms of the patient's torso.

4. The garment as in claim 3 wherein each of the long sleeves of the sweater member are provided with an elongated sleeve opening.

5. The garment as in claim 4 wherein each of the elongated sleeve openings are controlled by a pair of cooperating closure members.

6. The garment as in claim 5 wherein the front of the sweater member is provided with a relatively short vertical throat opening.

7. The garment as in claim 6 wherein the vertical throat opening is provided with a pair of cooperating closure members.

8. The garment as in claim 7 wherein the sweater member has a crew neck style neck opening.

9. The garment as in claim 7 wherein the pair of cooperating closure members are hook and loop style closure members.

10. A garment for patient's to wear while undergoing hemodialysis procedures wherein the garment comprises:

a garment unit including a sweater member having a pair of long sleeves and a neck opening wherein both of the sleeves are provided with elongated sleeve openings;

a thermal unit including a layer of thermal material that is attached to the interior surface of the sweater member and extends upwardly from approximately the horizontal midline of the sweater member; and a plurality of closure units including two pairs of cooperating hook and loop closure members which control the elongated sleeve openings.

11. The garment as in claim 10 wherein the layer of thermal material is dimensioned to cover the upper portion of the patient's torso.

12. The garment as in claim 11 wherein the layer of thermal material is dimensioned to cover the upper chest, upper back, and upper arms of the patient's torso.

13. The garment as in claim 12 wherein the front portion of the sweater member is provided with a relatively short vertical throat opening.

14. The garment as in claim 13 wherein said throat opening is controlled by a third pair of cooperating hook and loop closure members.

* * * * *